US011557866B2

(12) United States Patent
Hsu et al.

(10) Patent No.: US 11,557,866 B2
(45) Date of Patent: Jan. 17, 2023

(54) ELECTRICAL CONNECTOR AND A PARTITION THEREOF

(71) Applicant: ACES ELECTRONICS CO., LTD., Taoyuan (TW)

(72) Inventors: Wei-Chun Hsu, Taoyuan (TW); Rong-Hsun Kuo, Taoyuan (TW)

(73) Assignee: ACES ELECTRONICS CO., LTD., Taoyuan (TW)

( * ) Notice: Subject to any disclaimer, the term of this patent is extended or adjusted under 35 U.S.C. 154(b) by 32 days.

(21) Appl. No.: 17/200,044

(22) Filed: Mar. 12, 2021

(65) Prior Publication Data

US 2022/0037842 A1 Feb. 3, 2022

(30) Foreign Application Priority Data

Jul. 29, 2020 (TW) ..... 109209741

(51) Int. Cl.

| | |
|---|---|
| ***H01R 24/60*** | (2011.01) |
| ***H01R 13/40*** | (2006.01) |
| ***H01R 13/6583*** | (2011.01) |
| ***H01R 43/20*** | (2006.01) |

(52) U.S. Cl.

CPC ..... *H01R 24/60* (2013.01); *H01R 13/40* (2013.01); *H01R 13/6583* (2013.01); *H01R 43/20* (2013.01)

(58) Field of Classification Search

None

See application file for complete search history.

(56) References Cited

U.S. PATENT DOCUMENTS

| | | | | |
|---|---|---|---|---|
| 9,525,243 | B1 * | 12/2016 | Yuan | H01R 13/6585 |
| 2009/0163071 | A1 * | 6/2009 | Chen | H01R 13/6485 439/352 |
| 2016/0181729 | A1 * | 6/2016 | Barth | H01R 13/6273 439/37 |
| 2016/0276782 | A1 * | 9/2016 | Chang | H01R 13/6594 |
| 2017/0070013 | A1 * | 3/2017 | Hsu | H01R 13/6585 |
| 2018/0191102 | A1 * | 7/2018 | Arai | H01R 43/24 |
| 2018/0366882 | A1 * | 12/2018 | Tseng | H01R 13/516 |
| 2021/0135410 | A1 * | 5/2021 | Zhang | H01R 13/24 |

* cited by examiner

*Primary Examiner* — Oscar C Jimenez

(74) *Attorney, Agent, or Firm* — Muncy, Geissler, Olds & Lowe, P C.

(57) ABSTRACT

A partition of an electrical connector has a body and two extensions. The body has two outer sides opposite to each other. The extensions respectively connected to the outer sides of the body. Each of the extensions has a first bent leg, a second bent leg and an axis Each of the extensions is bent along the axis to stack the second bent leg on the first bent leg. Therefore, the thickness of the partition is increased to enhance the structure of the tongue, so that the stability of the electrical connector is enhanced.

17 Claims, 7 Drawing Sheets

ELECTRICAL CONNECTOR AND A PARTITION THEREOF

CROSS-REFERENCE TO RELATED APPLICATIONS

This application is based upon and claims priority under 35 U.S.C. 119 from Taiwan Patent Application No. 109209741 filed on Jul. 29, 2020, which is hereby specifically incorporated herein by this reference thereto.

BACKGROUND OF THE INVENTION

1. Field of the Invention

The present invention is related to an electrical connector, and more particularly an electrical connector and a partition thereof.

2. Description of the Prior Arts

The Universal Serial Bus (USB) is an industry standard about input and output of an electrical connector. Since the USB has the advantages of hot swapping and plug and play, the USB is widely used in the consumer electronics, such as personal computer, digital camera, smart phone, wearable device. The USB Implementer Forum, Inc. (USB-IF) publishes the latest USB Type-c standard to reach light weight and miniaturization of the consumer electronics. The USB Type-c has the advantages of the conventional USB and further has the advantages of smaller size and can be used on both sides.

However, as shown in FIG. 5, a conventional USB Type-c connector in accordance with prior art has a partition 50. The partition 50 is made by bending a metal sheet. When the USB Type-c connector connects to a corresponding connector, an insulator encapsulating the partition 50 of a tongue may be worn down. Further more, the tongue of the USB Type-c connector may be worn down and deformed to make the USB Type-c connector unstable after long-term repeatedly plugging and unplugging.

To overcome the shortcomings of the conventional USB Type-c, the present invention provides an electrical connector and a partition thereof to enhance the stability of the electrical connector to mitigate or to obviate the aforementioned problems.

SUMMARY OF THE INVENTION

An objective of the present invention is to provide an electrical connector and a partition thereof to enhance the stability of the electrical connector.

To achieve the objective as mentioned above, the partition of the electrical connector comprising:

A body having two outer sides, wherein the outer sides are opposite to each other; and two extensions respectively connected to the outer sides of the body, each of the extensions having a first bent leg;

a second bent leg stacked on the first bent leg; and an axis between the first bent leg and the second bent leg, wherein each of the extensions is bent along the axis to stack the second bent leg on the first bent leg.

Form the above description, each of the extensions is bent along the axis to stack the second bent leg on the first bent leg to increase the thickness of the extensions, so that the stability of the partition is increased.

To achieve the objective as mentioned above, the electrical connector comprising:

a casing;

a partition disposed in the casing and having a body having two outer sides, wherein the outer sides are opposite to each other;

a first surface; and a second surface; and two extensions respectively connected to the outer sides of the body, each of the extensions having a first bent leg;

a second bent leg stacked on the first bent leg; and an axis between the first bent leg and the second bent leg, wherein each of the extensions is bent along the axis to stack the second bent leg on the first bent leg;

a first terminal assembly disposed separately on the first surface;

a second terminal assembly disposed separately on the second surface; and an insulation partly encapsulates the partition, the first terminal assembly and the second terminal assembly and having an insulation part of the tongue, wherein part of the extensions are exposed from the insulation part of tongue; and a terminal seat.

Form the above description, each of the extensions is bent the second bent leg on the first bent leg to increase the thickness thereof at the insulation part of the tongue to enhance the stability of the partition, so that the stability of the electrical connector is enhanced.

Other objectives, advantages and novel features of the invention will become more apparent from the following detailed description when taken in conjunction with the accompanying drawings.

DETAILED DESCRIPTION OF THE EMBODIMENTS

The present invention is related to an electrical connector and a partition thereof. With embodiments and drawings thereof, the features of the present invention are described in detail as fallow.

Figure 1A:
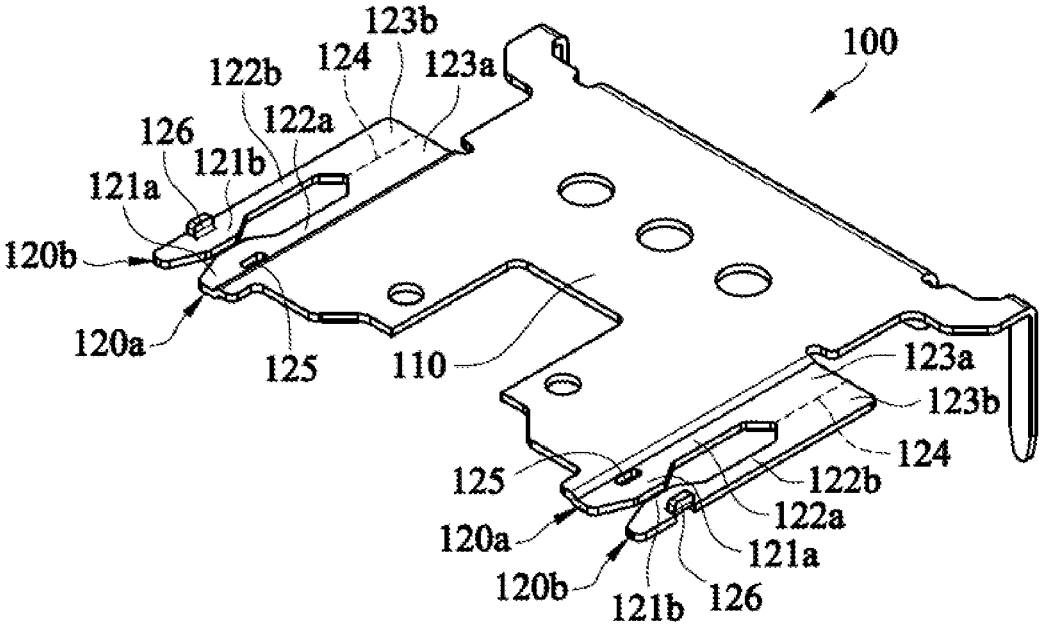
FIG. 1A is an operational perspective view of two extensions of a partition of an electrical connector in accordance with the present invention, showing the extensions not bent yet.
Figure 1B:
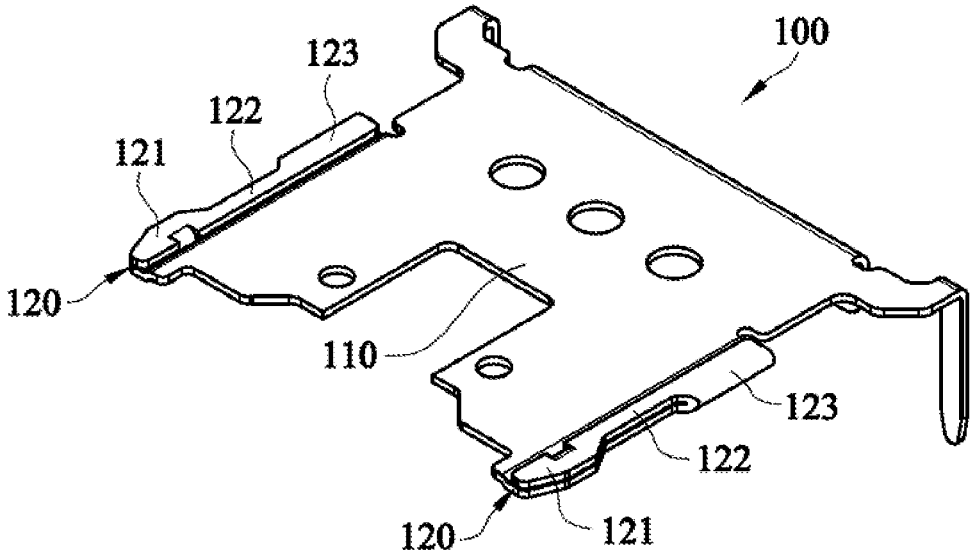
FIG. 1B is an operational perspective view of the two extensions of the partition of the electrical connector in FIG. 1A, showing the extensions bent.

With reference to FIGS. 1A and 1B, a first embodiment of a partition 100 of an electrical connector in accordance with the present invention has a body 110 and two extensions 120. In this embodiment, the extensions 120 are connected to corresponding outer sides of the body 110, which are opposite to each other. Each of the extensions 120 has a first bent leg 120*a*, a second bent leg 120*b* and an axis 124. The first bent leg 120*a*, the second bent leg 120*b* and the axis 124 are corresponding to another extension 120. In one embodiment, the partition 100 is made by stamping. Thus, each of the first bent legs 120*a* extends out from the corresponding outer side of the body 110. Each of the second bent legs 120*b* extends out from an outer side of a corresponding first bent leg 120*a*.

Each of the first bent legs 120*a* has a first protruding part 121*a*, a concave part 122*a* and a second protruding part 123*a* formed in sequence from the front side to the back side of the body 110. Each of the second bent legs 120*b* has a first protruding part 121*b*, a concave part 122*b* and a second protruding part 123*b* formed in sequence from the front side to the back side of the body 110. For each of the extensions 120, the second protruding part 123*a* of the first bent leg 120*a* and the second protruding part 123*b* of the second bent leg 120*b* are connected to each other. However, the first protruding part 121*a* of the first bent leg 120*a* and the first protruding part 121*b* of the second bent leg 120*b* are separated from each other, and the concave part 122*a* and 122*b* are separated from each other. In one embodiment, each of the first protruding parts 121*a* has a buttonhole 125 near to the corresponding outer side of the body 110 formed thereon. Each of the first protruding parts 121*b* has a button 126 stamped thereon and corresponding to the buttonhole 125.

With reference to FIG. 1B, each of the extensions 120 is bent upward along the axis 124 to stack the second bent leg 120*b* on the first bent leg 120*a*. Thus, the first protruding parts 121*b* are respectively stacked on the corresponding first protruding part 121*a* to assemble a first protruding part 121. The concave parts 122*b* are respectively stacked on the corresponding concave part 122*a* to assemble a concave part 122. The second protruding parts 123*b* are respectively stacked on the corresponding second protruding part 123*a* to assemble a second protruding part 123. The first protruding part 121, the concave part 122 and the second protruding part 123 of each of the extensions 120 formed in sequence from the front side to the back side of the body 110. The buttons 126 engage respectively with the buttonholes 125 to stack stably the second bent legs 120*b* on the first bent legs 120*a*.

With the foregoing description of the embodiment of the present invention, each of the extensions 120 is bent upward along the axis 124 to stack the second bent leg 120*b* on the first bent leg 120*a*, so the bent extensions 120 are thicker than the body 110. In one embodiment, the partition 100 is stamped by a metal with an uniform thickness, so the thickness of the extensions 120 are twice the thickness of the body 110.

Figure 2:
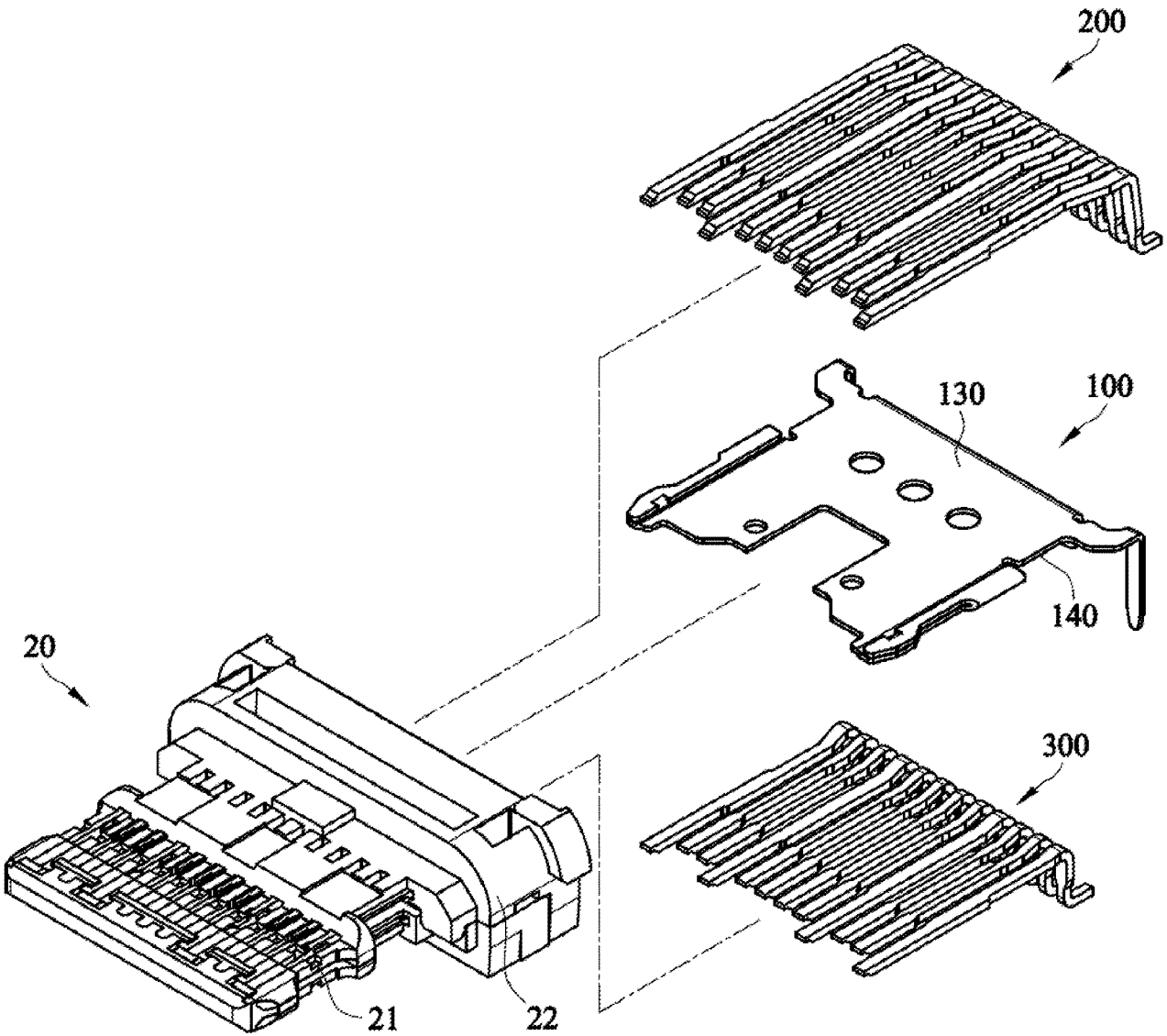
FIG. 2 is an exploded perspective view of a part of an electrical connector in accordance with the present invention.

With reference to FIG. 2, a first embodiment of a tongue 10 of an electrical connector in accordance with the present invention has a first terminal assembly 200, the partition 100, a second terminal assembly 300 and an insulation 20. The first terminal assembly 200 is disposed separately on a first surface 130 of the body 110. The second terminal assembly 300 is disposed separately on a second surface 140 of the body 110. The insulation 20 comprises an insulation part of tongue 21 and a terminal seat 22. The insulation 20 partly encapsulates the partition 100, the first terminal assembly 200 and the second terminal assembly 300. Thus, the concave part 122 and the second protruding part 123 of each of the extensions 120 are exposed from the insulation 20.

Figure 3A:
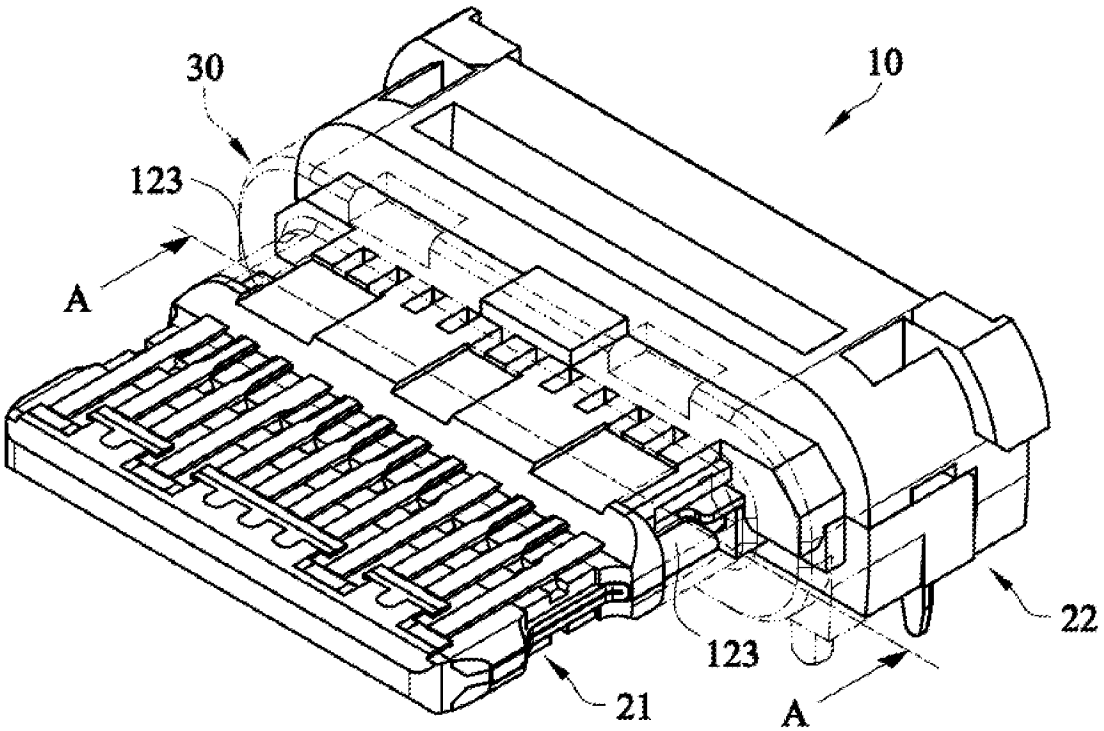
FIG. 3A is a perspective view of a part of the electrical connector in FIG. 2.
Figure 3B:
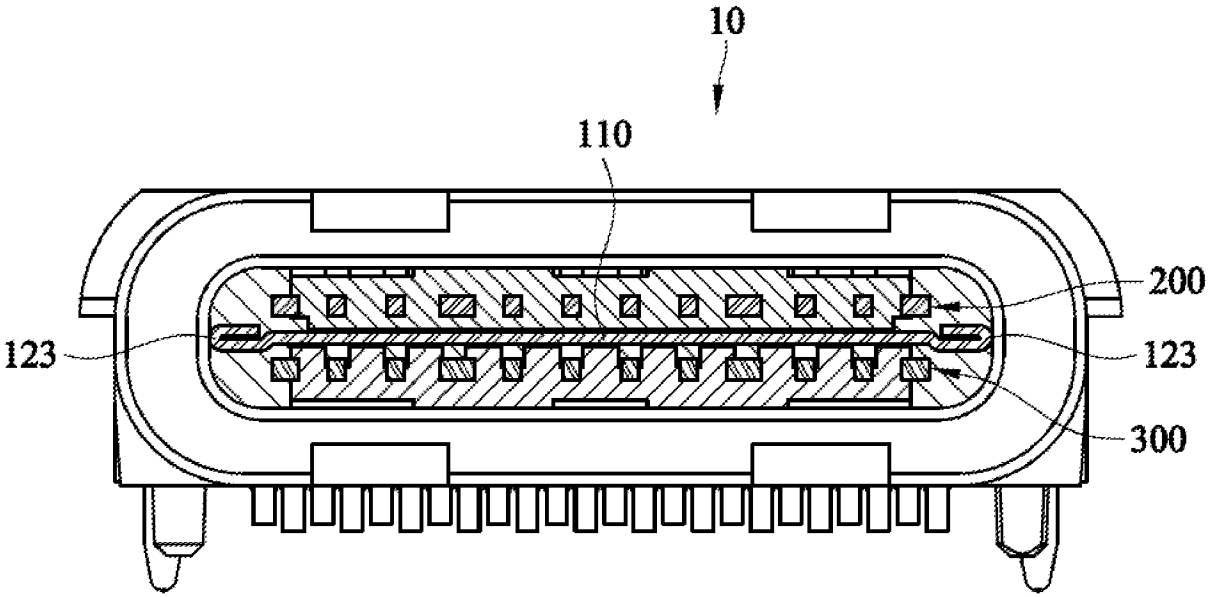
FIG. 3B is an end view in partial section along the line A-A in FIG. 3A.

With reference to FIG. 3A, the tongue 10 further has an EMI shielding area 30 corresponding to the insulation part of tongue 21 and near to the terminal seat 22. With reference to FIGS. 1B and 3B, the second protruding 123 extends toward the EMI shielding area 30. The body 110 is thinner than the first terminal assembly 200 and the second terminal assembly 300, but not limit thereto. In one embodiment, the body 110 is thicker than the first terminal assembly 200 and the second terminal assembly 300. The second protruding part 123 is thicker than the first terminal assembly 200 and the second terminal assembly 300, so the extensions 120 are thicker than the first terminal assembly 200 and the second terminal assembly 300.

Figure 4A:
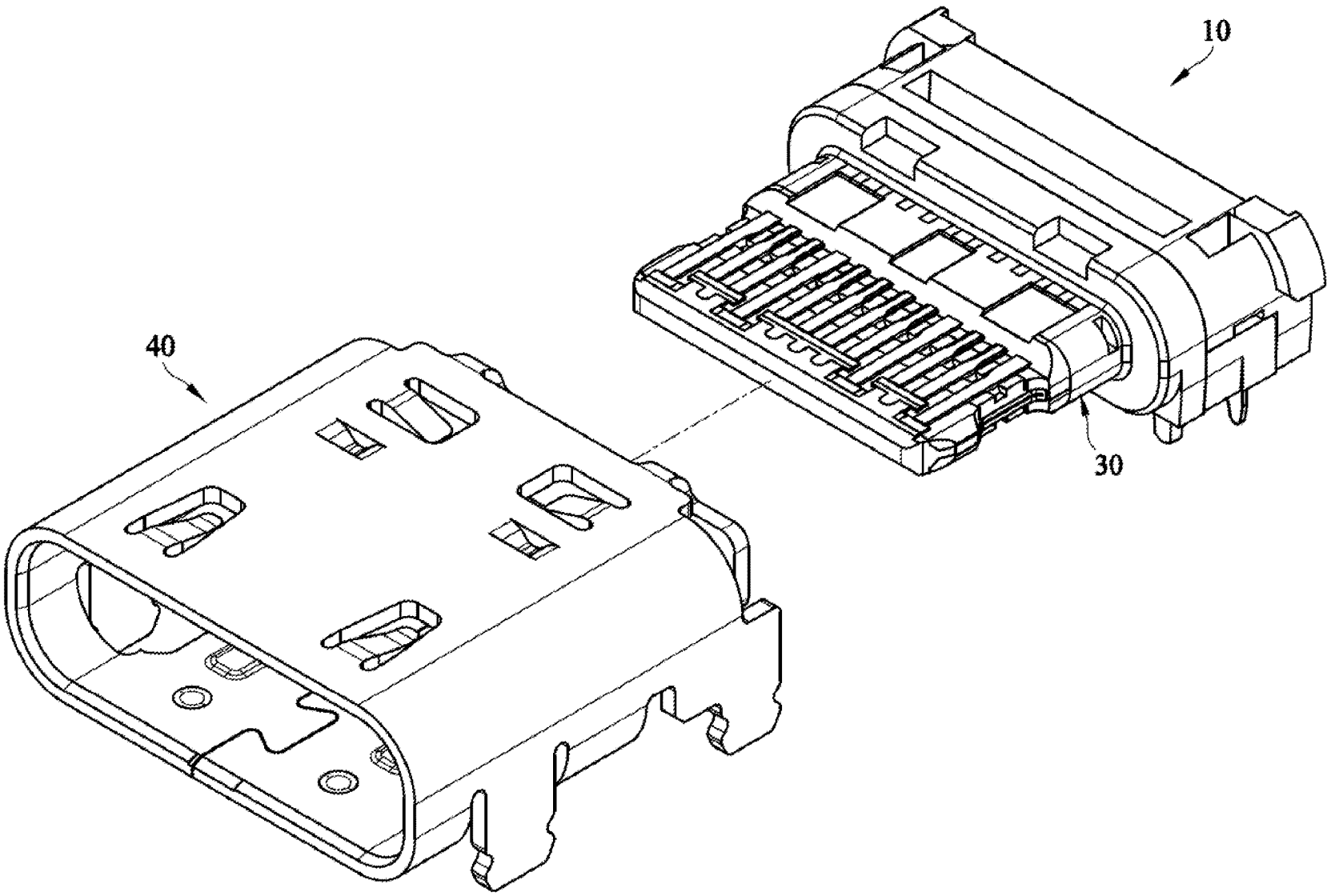
FIG. 4A is an exploded perspective view of an electrical connector in accordance with the present invention.
Figure 4B:
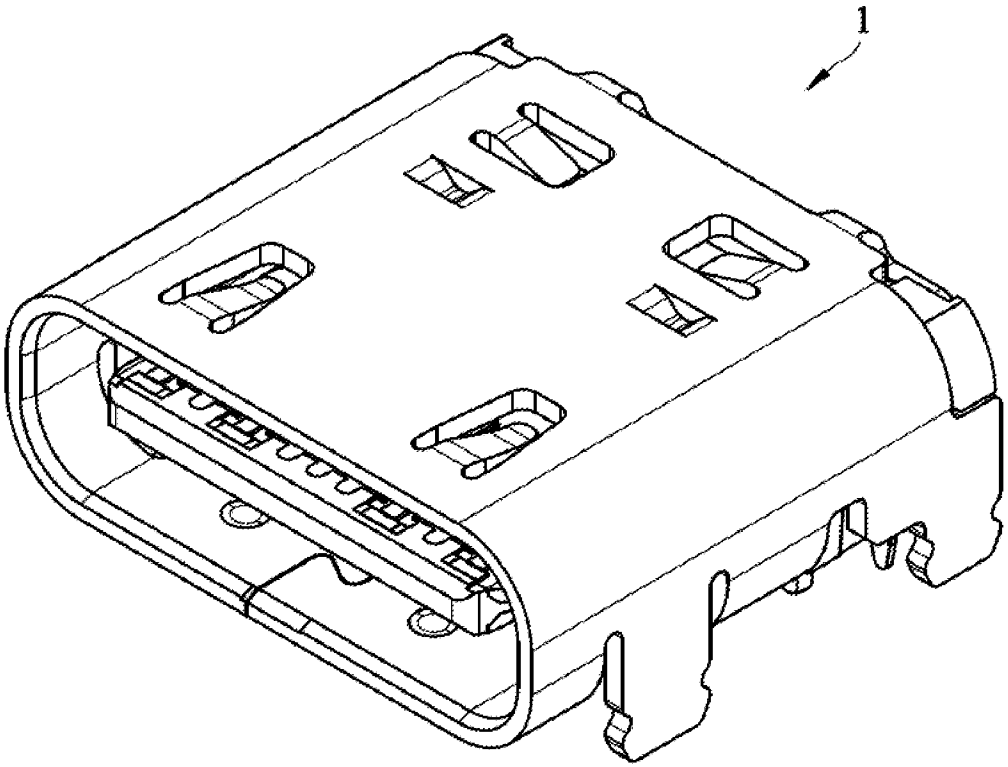
FIG. 4B is a perspective view of the electrical connector in FIG. 4A.
Figure 5:
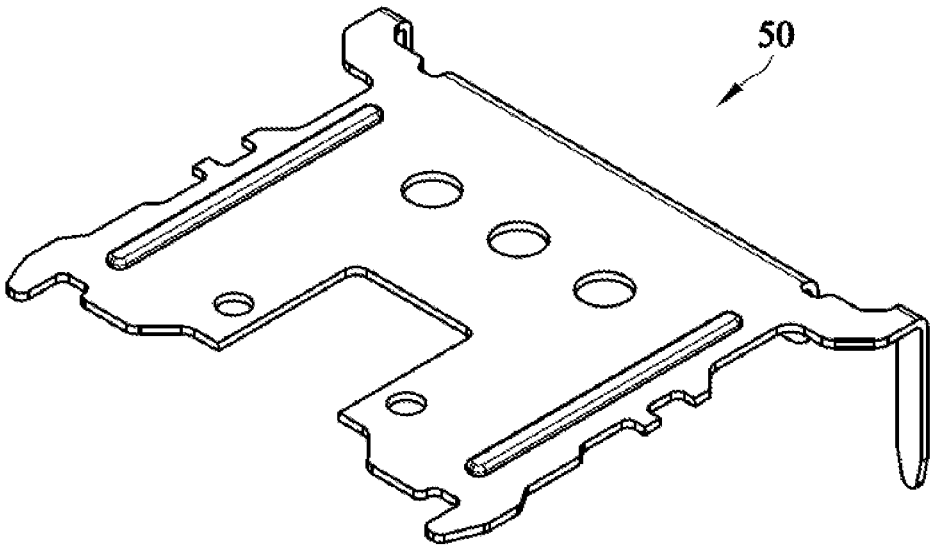
FIG. 5 (prior art)
FIG. 5 is a perspective view of a conventional partition of an electrical connector in accordance with the prior art.

With reference to FIGS. 4A and 4B, a first embodiment of an electrical connector 1 in accordance with the present invention has the tongue 10 and a casing 40. In this embodiment, the second protruding part 123 of the partition 100 enhances the structure of the tongue 10 to enhance the stability of the electrical connector 1.

In conclusion, each of the extensions is bent upward to stack the second bent leg on the first bent leg to increase the thickness thereof, so that the stability of the partition is enhanced. The partition is used in the electrical connector to enhance the structure of the tongue, so that the stability of the electrical connector is also enhanced. Further, the extensions are thicker than the body of the partition, so the thickness of the first terminal assembly and the second terminal assembly are increased to support larger current.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A partition of an electrical connector comprising: a body having two outer sides, wherein the outer sides are opposite to each other; and two extensions respectively connected to the outer sides of the body, each of the extensions having a first bent leg; a second bent leg stacked on the first bent leg; and an axis between the first bent leg and the second bent leg, wherein each of the extensions is bent along the axis to stack the second bent leg on the first bent leg; wherein each of the first bent legs has a first protruding part formed near a front side of the body: a second protruding part formed near a back side of the body; and a concave part formed between the first protruding part and the second protruding part; and each of the second bent legs has a first protruding part formed near the front side of the body; a second protruding part formed near the back side of the body; and a concave part formed between the first protruding part and the second.

2. The partition as claimed in claim 1, wherein the second protruding part of each of the first bent legs and the corresponding second protruding part of each of the second bent legs are connected to each other.

3. The partition as claimed in claim 2, wherein each of the extensions is bent upward along the axis to stack the second bent leg on the first bent leg.

4. The partition as claimed in claim 2, wherein the partition is made by stamping.

5. The partition as claimed in claim 1, wherein each of the first bent legs further has a buttonhole formed near the corresponding outer side of the body; and each of the second bent legs further has a button corresponding to and engaging with the buttonhole of a corresponding one of the first bent legs.

6. The partition as claimed in claim 1, wherein each of the extensions is bent upward along the axis to stack the second bent leg on the first bent leg.

7. The partition as claimed in claim 1, wherein the partition is made by stamping.

8. An electrical connector comprising: a casing; a partition disposed in the casing and having a body having two outer sides, wherein the outer sides are opposite to each other; a first surface; and a second surface; and two extensions respectively connected to the outer sides of the body, each of the extensions having a first bent leg; a second bent leg stacked on the first bent leg; and an axis between the first bent leg and the second bent leg, wherein each of the extensions is bent along the axis to stack the second bent leg on the first bent leg; a first terminal assembly disposed separately on the first surface; a second terminal assembly disposed separately on the second surface; and an insulation partly encapsulates the partition, the first terminal assembly and the second terminal assembly and having an insulation part of tongue, wherein part of the extensions are exposed from the insulation part of tongue; and a terminal seat: wherein each of the first bent legs has a first protruding part formed near a front side of the body; a second protruding part formed near a back side of the body; and a concave part formed between the first protruding part and the second protruding part; and each of the second bent legs has a first protruding part formed near the front side of the body; a second protruding part formed near the back side of the body; and a concave part formed between the first protruding part and the second.

9. The electrical connector as claimed in claim 8, wherein the second protruding part of each of the first bent legs and the corresponding second protruding part of each of the second bent legs are connected to each other.

10. The electrical connector as claimed in claim 9, wherein the partition is made by stamping.

11. The electrical connector as claimed in claim 9, wherein the body of the partition is thinner than the first terminal assembly and the second terminal assembly; and the extensions of the partition are thicker than the first terminal assembly and the second terminal assembly.

12. The electrical connector as claimed in claim 9, wherein the body of the partition is thicker than the first terminal assembly and the second terminal assembly.

13. The electrical connector as claimed in claim 8, wherein each of the first bent legs further has a buttonhole formed near the corresponding outer side of the body; and each of the second bent legs further has a button corresponding to and engaging with the buttonhole of a corresponding one of the first bent legs.

14. The electrical connector as claimed in claim 8, wherein the insulation further has an EMI shielding area; and the second protruding parts extend toward the EMI shielding.

15. The electrical connector as claimed in claim 8, wherein the partition is made by stamping.

16. The electrical connector as claimed in claim 8, wherein the body of the partition is thinner than the first terminal assembly and the second terminal assembly; and the extensions of the partition are thicker than the first terminal assembly and the second terminal assembly.

17. The electrical connector as claimed in claim 8, wherein the body of the partition is thicker than the first terminal assembly and the second terminal assembly.

* * * * *